US009802170B2

(12) United States Patent
Endo

(10) Patent No.: US 9,802,170 B2
(45) Date of Patent: Oct. 31, 2017

(54) ANALYZER AND AGITATION UNIT

(71) Applicant: SYSMEX CORPORATION, Kobe-shi, Hyogo (JP)

(72) Inventor: Takayuki Endo, Kobe (JP)

(73) Assignee: SYSMEX CORPORATION, Kobe-shi (JP)

( * ) Notice: Subject to any disclaimer, the term of this patent is extended or adjusted under 35 U.S.C. 154(b) by 134 days.

(21) Appl. No.: 14/867,141

(22) Filed: Sep. 28, 2015

(65) Prior Publication Data

US 2016/0089644 A1 Mar. 31, 2016

(30) Foreign Application Priority Data

Sep. 30, 2014 (JP) ..... 2014-199754

(51) Int. Cl.
*B01F 11/00* (2006.01)
*B01F 15/00* (2006.01)

(52) U.S. Cl.
CPC .... *B01F 11/0005* (2013.01); *B01F 15/00129* (2013.01); *B01F 15/00285* (2013.01); *B01F 2215/0037* (2013.01)

(58) Field of Classification Search
CPC ..... B01F 11/0005
See application file for complete search history.

(56) References Cited

U.S. PATENT DOCUMENTS

| | | | | |
|---|---|---|---|---|
| 5,642,938 | A | 7/1997 | Nakagawa et al. | |
| 2003/0063281 | A1* | 4/2003 | Katane | G01N 21/9027 356/427 |
| 2009/0009757 | A1* | 1/2009 | Mototsu | B01L 3/5082 356/246 |
| 2013/0183198 | A1* | 7/2013 | Tokunaga | G01N 21/59 422/68.1 |
| 2015/0146496 | A1* | 5/2015 | Lucon | B01J 2/006 366/111 |

FOREIGN PATENT DOCUMENTS

| | | | |
|---|---|---|---|
| JP | H08-299775 | A | 11/1996 |
| JP | 2008-064713 | A | 3/2008 |
| JP | 2010-060334 | A | 3/2010 |

* cited by examiner

*Primary Examiner* — Clayton E Laballe
*Assistant Examiner* — Dennis Hancock
(74) *Attorney, Agent, or Firm* — Metrolexis Law Group, PLLC

(57) ABSTRACT

Analyzers are described that control sample agitation by detecting vibration acceleration and using feedback to control the agitation and also alert to the presence of abnormal agitation. An embodiment provides an analyzer comprising a liquid agitation unit; an agitated liquid analysis unit; and a unit that controls the agitation unit. The agitation unit includes a vibrator of a liquid container and a detector of vibration of the container and that outputs a signal to the control unit, which responds by regulating the vibrator.

20 Claims, 13 Drawing Sheets

FIRST MOTOR REVOLUTION SPEED CONTROL PROCESSING

SECOND MOTOR REVOLUTION SPEED CONTROL PROCESSING

ANALYZER AND AGITATION UNIT

CROSS REFERENCE TO RELATED APPLICATIONS

This application claims priority to prior Japanese Patent Application No. 2014-199754 filed on Sep. 30, 2014 entitled "ANALYZER AND AGITATION UNIT," the entire contents of which are hereby incorporated by reference.

BACKGROUND

This disclosure relates to an analyzer and to an agitation unit.

Analyzers are known that analyze samples such as blood and that have an agitation device. The agitation device agitates a liquid such as a sample, a reagent, or a mixture thereof to prepare a measurement specimen.

For example, an agitation device disclosed in Japanese Patent Application Publication No. Hei 8-299775 (Patent Document 1) vibrates a container held by a hand section by vibrating a support member with a vibration motor, and thereby agitates a liquid in the container.

SUMMARY

The scope of embodiments is defined solely by the appended claims, and is not affected to any degree by statements within this summary.

(I) An embodiment of an analyzer comprising: an agitation unit that agitates a liquid; an analysis unit that analyzes the agitated liquid; and a control unit that controls an operation of the agitation unit, wherein the agitation unit includes a vibrator that causes vibration of a container containing the liquid, and a detector that detects vibration of the container, and the control unit regulate the vibrator to correct the vibration based on a detection result by the detector.

(II) An embodiment of an agitation unit comprising: a holder member that holds a container containing a liquid; a support member that supports the holder member; an elastic member that connects the support member to the holder member; a drive member that is attached to the holder member and vibrates the holder member pivotally around the elastic member; and a detector that is attached to the holder member and detects a state of vibration of the holder member.

(III) An embodiment of an analyzer comprising: the agitation unit according to the aspect (II) that agitates a liquid; and an analysis unit that performs an analysis by using the agitated liquid.

DETAILED DESCRIPTION

[First Embodiment]

(Overall Configuration of Analyzer)

Analyzer 10 is an immune analyzer that performs tests on various analytes including hepatitis B virus, hepatitis C virus, a tumor marker, thyroid hormone, and the like which are contained in a sample such as a serum, by use of antigen-antibody reactions, for example.

Figure 1:
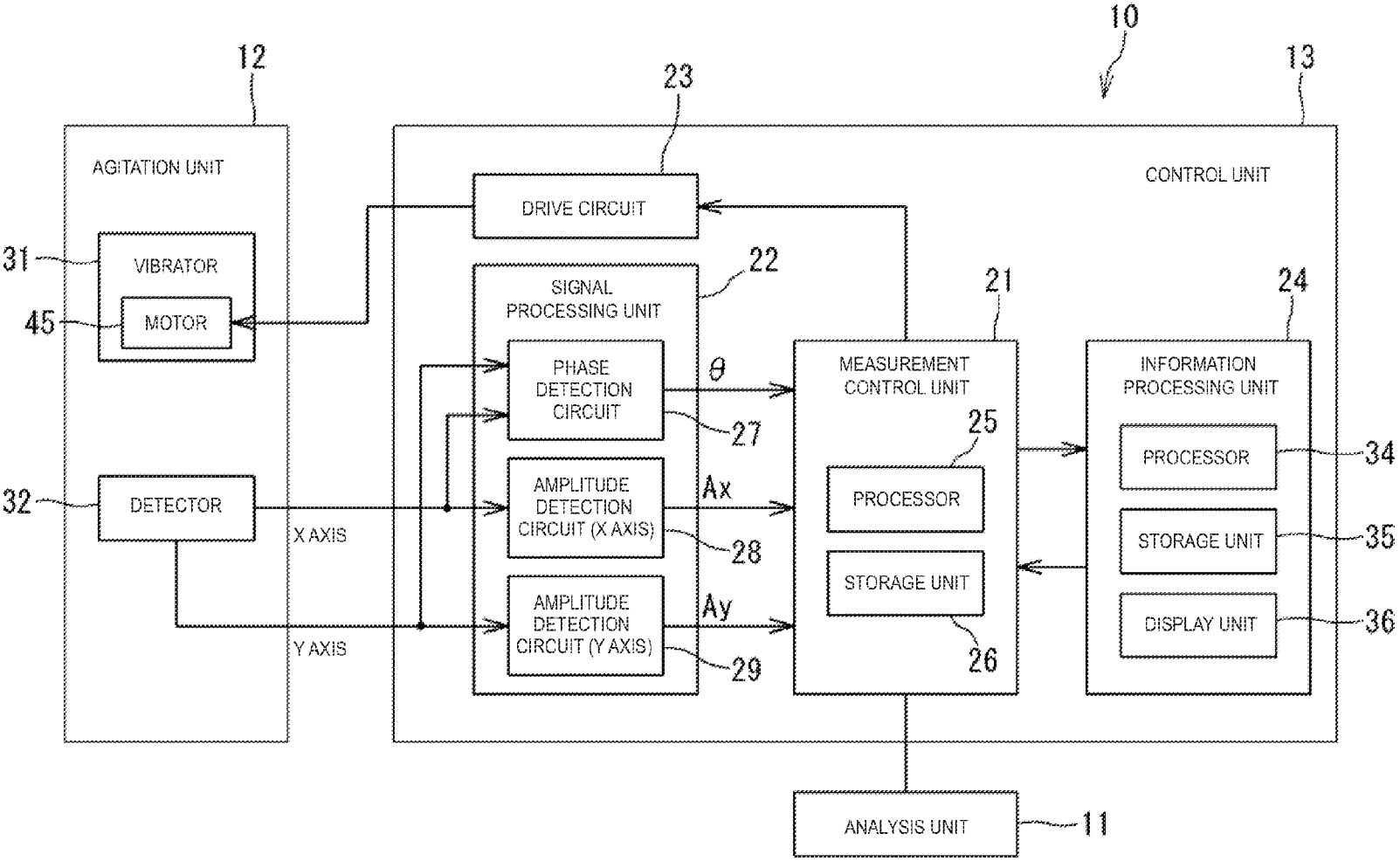
FIG. 1 is a block diagram of an analyzer according to a first embodiment.

As illustrated in FIG. 1, analyzer 10 includes analysis unit 11, agitation unit 12, and control unit 13. Analysis unit 11 performs measurements of predetermined parameters on a measurement specimen prepared by mixing a sample as a measurement object with a reagent, and thus analyzes properties and the like of the sample. An analysis result by analysis unit 11 is transmitted to control unit 13 and is appropriately processed.

Figure 2:
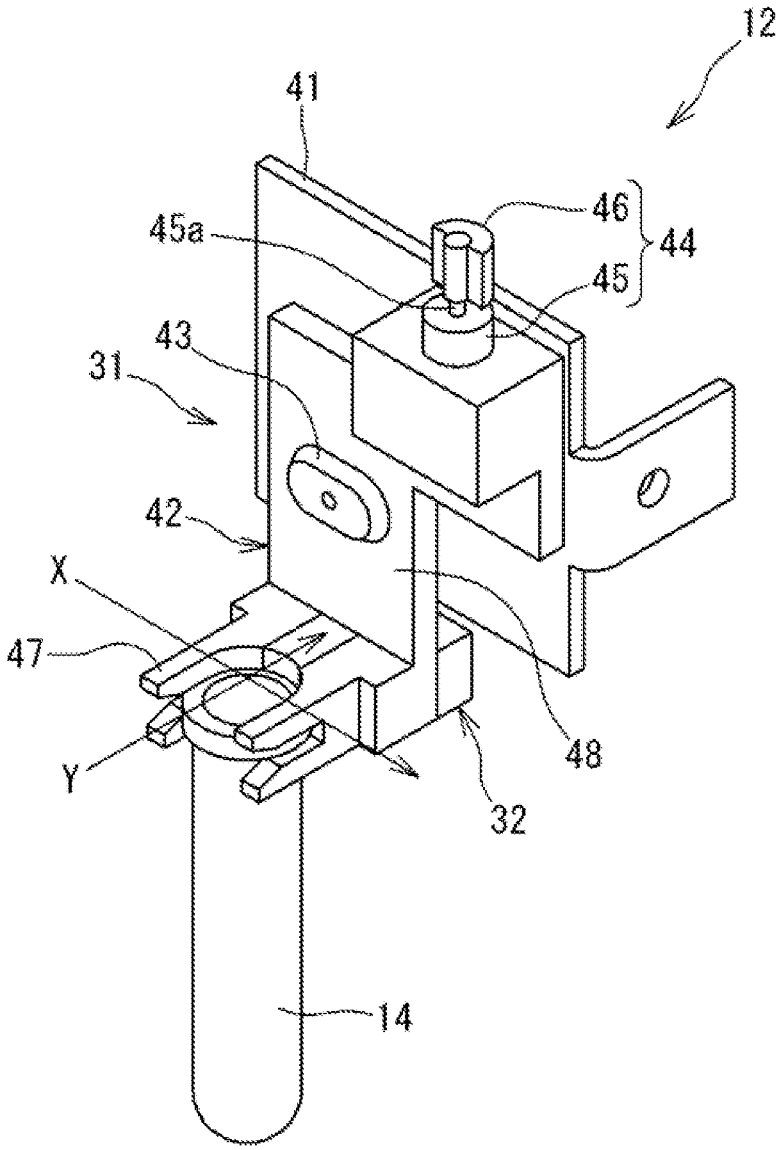
FIG. 2 is a perspective view of an agitation unit.

Agitation unit 12 agitates and mixes the sample and the reagent together in order to prepare the measurement specimen for use in the analysis. As illustrated in FIG. 2, agitation unit 12 includes vibrator 31 and detector 32. Vibrator 31 vibrates container 14 that contains a liquid including the sample, the reagent, and the like, thereby agitating the liquid. As illustrated in FIG. 1 and FIG. 2, vibrator 31 includes motor 45, which vibrates container 14. Meanwhile, an acceleration sensor, for example, can be used as detector 32. Further details of agitation unit 12 are described later.

Control unit 13 includes measurement control unit 21, signal processing unit 22, drive circuit 23, and information processing unit 24. Measurement control unit 21 mainly performs operation control of analysis unit 11 and agitation unit 12. Measurement control unit 21 is provided with processor 25 such as a CPU, and storage unit 26 which includes a ROM, a RAM, and the like. Processor 25 executes a computer program stored in storage unit 26. Thus, measurement control unit 21 performs the operation control of agitation unit 12 and analysis unit 11, processing of the analysis result by analysis unit 11, and the like. Part of the functions of measurement control unit 21 may be carried out by a hardware circuit.

Signal processing unit 22 acquires predetermined signals by processing detection signals by detector 32 provided in agitation unit 12, and outputs the signals to measurement control unit 21. Specifically, signal processing unit 22 includes phase detection circuit 27 and amplitude detection circuits 28 and 29. Phase detection circuit 27 converts a detection signal by detector 32 into a signal concerning a phase, and amplitude detection circuits 28 and 29 convert detection signals by detector 32 into signals concerning amplitudes. Specific operations of detection circuits 27, 28, and 29 are described later.

Drive circuit 23 drives motor 45 provided in agitation unit 12 in accordance with a control signal inputted from measurement control unit 21.

Information processing unit 24 is provided with: processor 34 such as a CPU; storage unit 35 which includes a ROM, a RAM, a hard disk, and the like; and display unit 36. A liquid crystal monitor, a CRT or the like is used as display unit 36. Processor 34 executes a computer program installed in storage unit 35. Thus, information processing unit 24 exerts functions including communication with measurement control unit 21, and so forth. In addition, information processing unit 24 also receives an analysis order, instructs analysis unit 11 and agitation unit 12 to start operations, and performs processing, including output of the analysis result and the like.

(A Specific Configuration of Agitation Unit 12)

Figure 3:
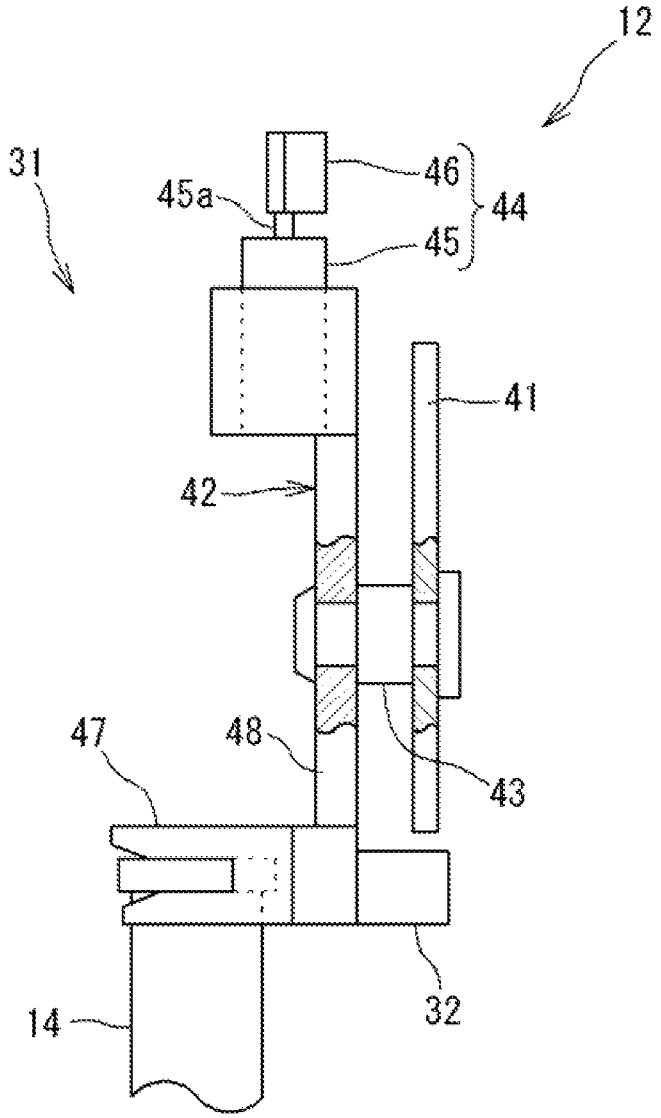
FIG. 3 is a partial cutaway side view of the agitation unit.

In an embodiment, agitation unit 12 vibrates container 14, which contains the sample and the reagent in order to prepare the measurement specimen, and agitates and thereby mixes the sample and the reagent together. As described above, agitation unit 12 includes vibrator 31 provided with motor 45, and detector 32. As illustrated in FIG. 2 and FIG. 3, vibrator 31 includes support member 41, holder member 42, elastic member 43, and drive member 44.

Support member 41 is made of a metallic plate material. Support member 41 is connected to a movement mechanism (not shown) installed in analyzer 10, and moves at least in one direction out of a vertical direction, a front-back direction, and a right-left direction by the movement mechanism. In the following description, an X-axis direction in FIG. 2 is also referred to as the right-left direction and a Y-axis direction in FIG. 2 is also referred to as the front-back direction.

Holder member 42 is arranged in front of support member 41 while providing a space in between, and holds container 14 that contains the liquid. Container 14 in the first embodiment is formed into a vertically elongated bottomed cylindrical shape, and an upper end of container 14 is opened. Holder member 42 includes catch section 47, which nips and holds the upper end of container 14 from two sides. Holder member 42 also includes body section 48 provided with catch section 47 at a lower end. Body section 48 is formed into a vertically elongated shape. Catch section 47 and body section 48 are made of a synthetic resin material and the like.

Drive member 44 is provided at a position eccentric to one side in the right-left direction at an upper part of body section 48 of holder member 42. Drive member 44 includes motor 45 and weight 46. Motor 45 includes output shaft 45*a*, which projects upward. Weight 46 is attached to output shaft 45*a*. Weight 46 is formed into a semicircular shape in a plan view. Output shaft 45*a* is located at the radial center of weight 46. Since weight 46 is rotated around output shaft 45*a*, the rotation center and the gravity center of weight 46 are decentered from each other. For this reason, drive member 44 creates vibration by the rotation of output shaft 45*a*.

An intermediate part in the vertical direction of body section 48 of holder member 42 is connected to support member 41 by use of elastic member 43. Elastic member 43 is formed into a tubular shape with the axial center in the front-back direction. One end portion in the axial direction of elastic member 43 is connected to support member 41 while the other end portion is connected to holder member 42. Support member 41 and holder member 42 can move relative to each other by means of elastic deformation of elastic member 43. Elastic member 43 is made of rubber. However, elastic member 43 may be formed from a spring made of a metal or a synthetic resin material instead.

Figure 4:
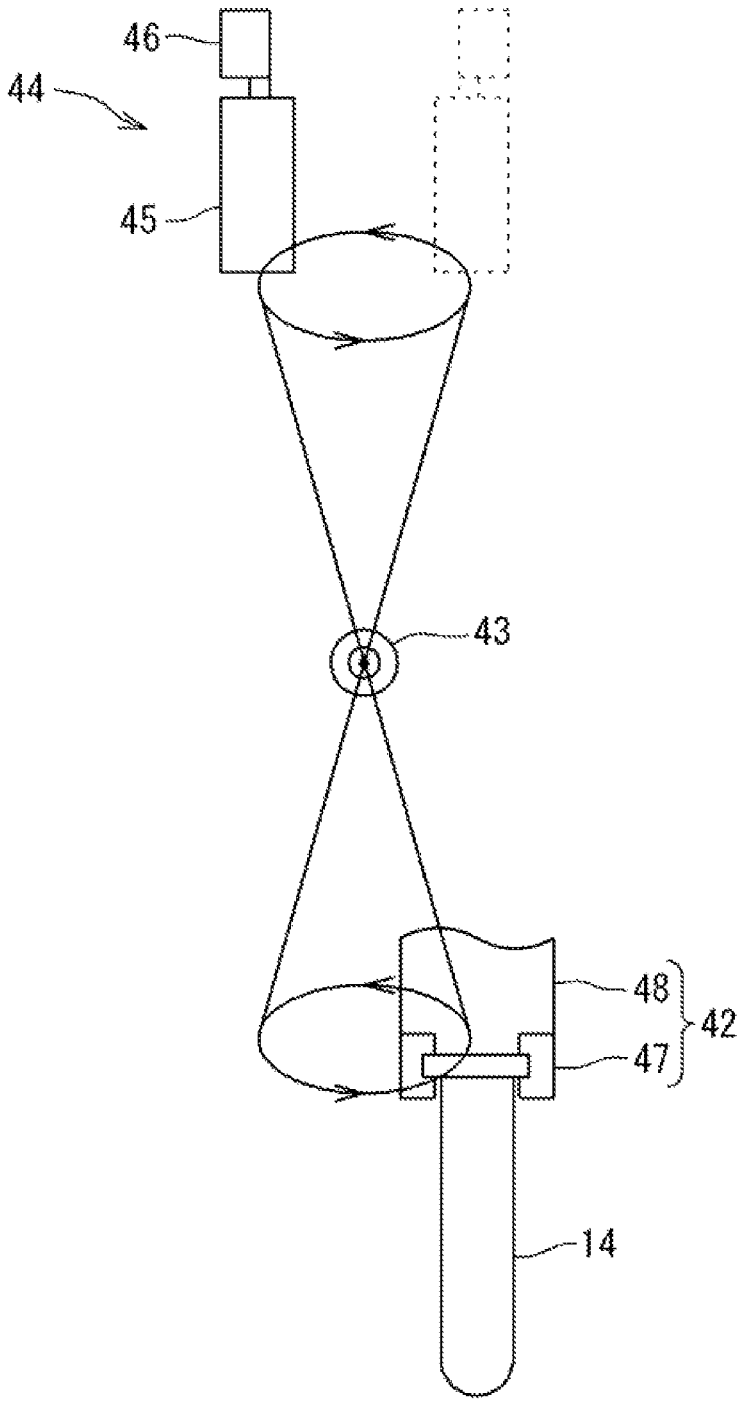
FIG. 4 is an explanatory diagram of an agitation operation of a container.

As described above, since drive member 44 is provided with weight 46 decentered from the rotation center, drive member 44 creates the vibration by rotating weight 46. As illustrated in FIG. 4, holder member 42 performs a conical rotational motion pivotally around elastic member 43 by the vibration created by drive member 44. Accordingly, container 14 held by catch section 47 of holder member 42 performs a rotational motion likewise.

As illustrated in FIG. 2 and FIG. 3, detector 32 is attached to a back face side of catch section 47 of holder member 42. Detector 32 detects acceleration rates of holder member 42 in two mutually orthogonal directions, namely, the X-axis direction and the Y-axis direction along a horizontal plane. Detector 32 detects the acceleration rates of holder member 42 and thereby indirectly detects acceleration rates of container 14 held by holder member 42.

As illustrated in FIG. 1, a detection result by detector 32 is inputted to signal processing unit 22 of control unit 13. An acceleration rate signal in the X-axis direction is inputted to phase detection circuit 27 and amplitude detection circuit 28 for the X-axis direction. An acceleration rate signal in the Y-axis direction is inputted to phase detection circuit 27 and amplitude detection circuit 29 for the Y-axis direction. Phase detection circuit 27 converts the inputted acceleration rate signals in the X-axis direction and the Y-axis direction into position signals in the respective directions, and obtains phase difference θ between the axis directions. Amplitude detection circuits 28 and 29 for the X-axis direction and the Y-axis direction convert the inputted acceleration rate signals into position signals in the X-axis direction and the Y-axis direction, and obtain amplitudes Ax and Ay in the axis directions.

Figure 5B:
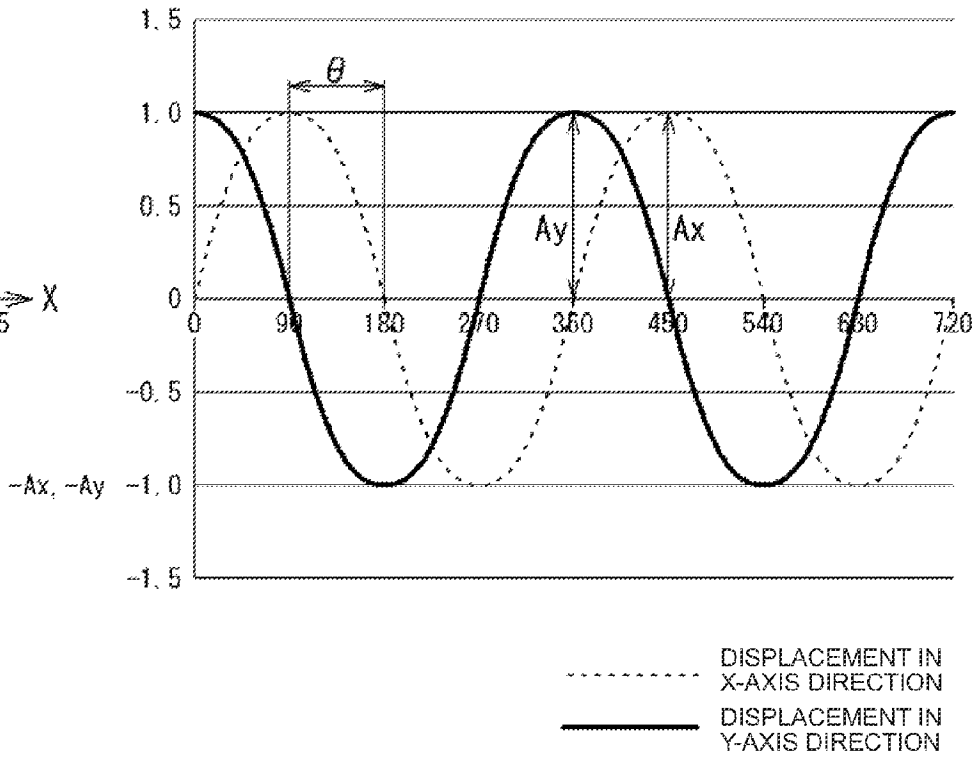
FIG. 5B is a graph showing changes in positions in an X-axis direction and a Y-axis direction of the holder member.
Figure 5A:
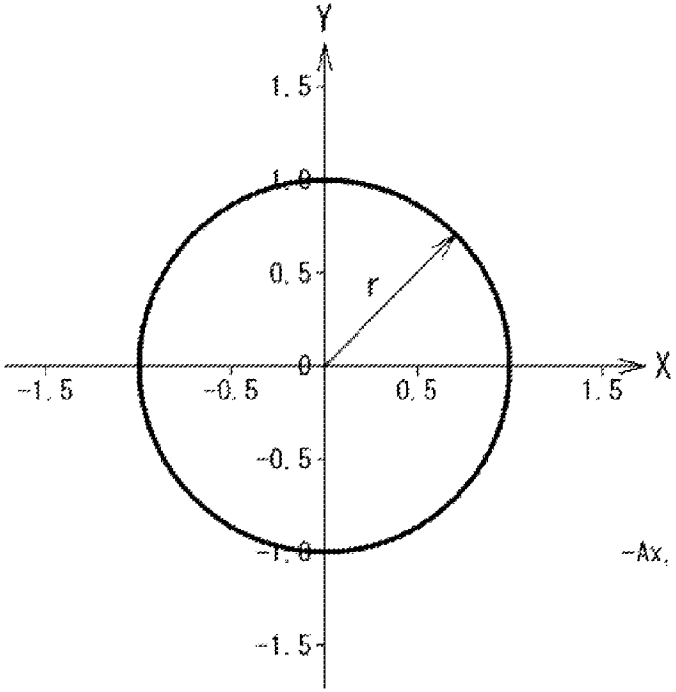
FIG. 5A is a graph showing rotational trajectory of a holder member for normal agitation.

FIG. 5A and FIG. 5B illustrate displacements of holder member 42 when agitation of the liquid is normal. In a graph of FIG. 5A, the horizontal axis indicates the position in the X-axis direction and the vertical axis indicates the position in the Y-axis direction. In this example, holder member 42 is rotated along a perfect circular trajectory. In a graph of FIG. 5B, the horizontal axis indicates a rotation angle that represents the phase, and the vertical axis indicates the positions in the X-axis direction and the Y-axis direction. In this case, the positions in the X-axis direction and the Y-axis direction of holder member 42 change while drawing sinusoidal waves, respectively. Of holder member 42, the amplitude Ax in the X-axis direction and the amplitude Ax in the Y-axis direction are equal to each other, and the phase difference θ between the phase in the X-axis direction and the phase in the Y-axis direction is equal to 90°.

The amplitudes Ax and Ay as well as the phase difference θ of holder member 42 represent vibration states and serve as state parameters used for controlling agitation unit 12. Here, a rotation radius r in the normal case illustrated in FIG. 5A and the amplitudes Ax and Ay in the normal case illustrated in FIG. 5B are each defined as "1". The rotation radii r and the amplitudes Ax and Ay in FIG. 6A to FIG. 8B to be described next represent relative values to the rotation radius r and the amplitudes Ax and Ay in FIG. 5.

FIG. 6A to FIG. 8B illustrate displacements of holder member 42 when the agitation of the liquid is abnormal.

Figure 6B:
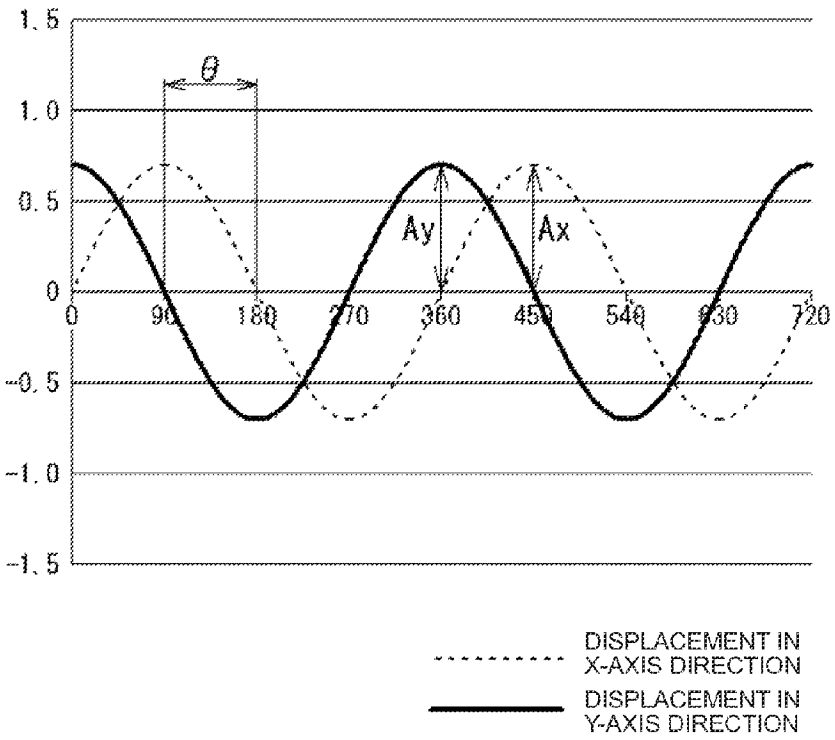
FIG. 6B is a graph showing changes in positions in the X-axis direction and the Y-axis direction of the holder member.
Figure 6A:
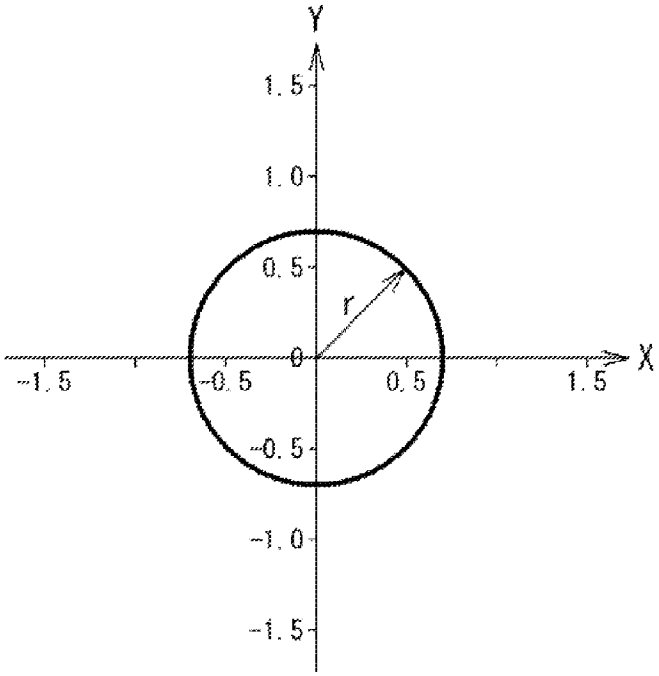
FIG. 6A is a graph showing rotational trajectory of a holder member when a rotation radius of the holder member is smaller than that for normal agitation.

FIG. 6A illustrates a case where the agitation becomes abnormal due to the reason that the rotation radius r of holder member 42 is smaller than that in the normal case. In this case, as illustrated in FIG. 6B, the phase difference θ between the phase in the X-axis direction and the phase in the Y-axis direction is equal to 90° as with the normal case, and the amplitude Ax and the amplitude Ay are equal to each other. Accordingly, the rotational trajectory of holder member 42 becomes a perfect circular shape. However, the rotation radius r is smaller than that in the normal case. When the rotation radius r is small as described above, the liquid in container 14 is prone to be incompletely mixed. As a consequence, the agitation becomes abnormal.

Figure 7B:
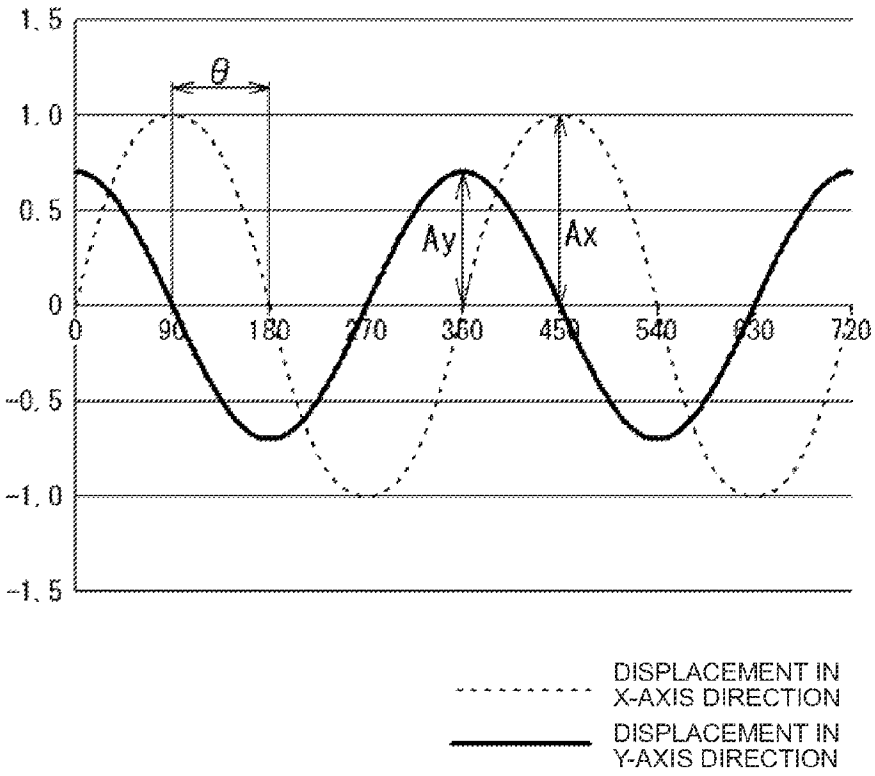
FIG. 7B is a graph showing changes in positions in the X-axis direction and the Y-axis direction of the holder member.
Figure 7A:
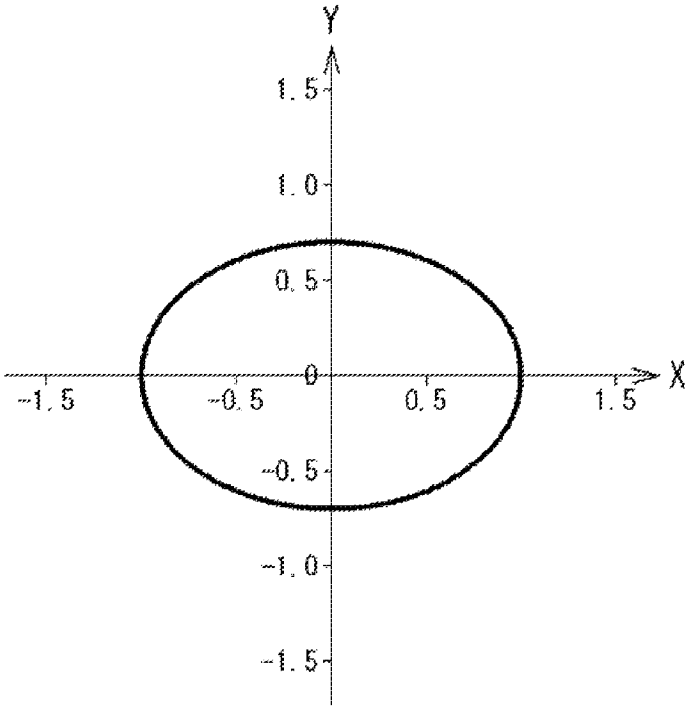
FIG. 7A is a graph showing rotational trajectory of a holder member during abnormal agitation.

FIG. 7A illustrates a case where the agitation becomes abnormal because the rotational trajectory of holder member 42 is oval. In this case, as illustrated in FIG. 7B, the phase difference θ between the phase in the X-axis direction and the phase in the Y-axis direction is equal to 90°, whereas the amplitude Ax and the amplitude Ay are different from each other. Specifically, the amplitude Ay in the Y-axis direction is smaller than the amplitude Ax in the X-axis direction. Accordingly, the rotational trajectory illustrated in FIG. 7A becomes an oval shape which is slightly flattened in the Y-axis direction. When holder member 42 is rotated along the oval rotational trajectory as described above, the liquid in container 14 is prone to be agitated more in the major axis direction of the oval but less in the minor axis direction thereof, and to be incompletely mixed. As a consequence, the agitation becomes abnormal.

Figure 8B:
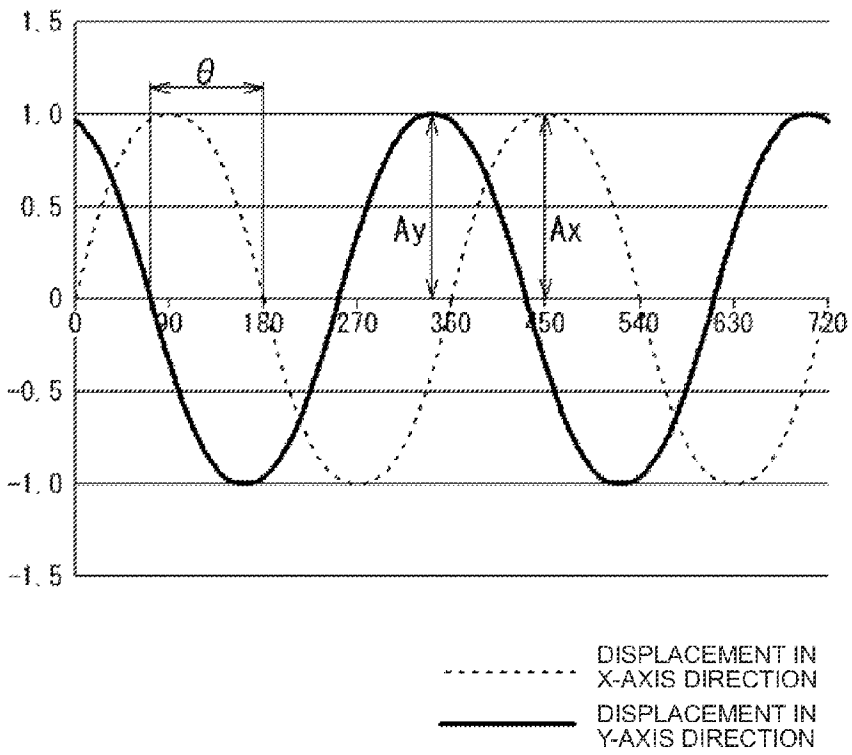
FIG. 8B is a graph showing changes in positions in the X-axis direction and the Y-axis direction of the holder member.
Figure 8A:
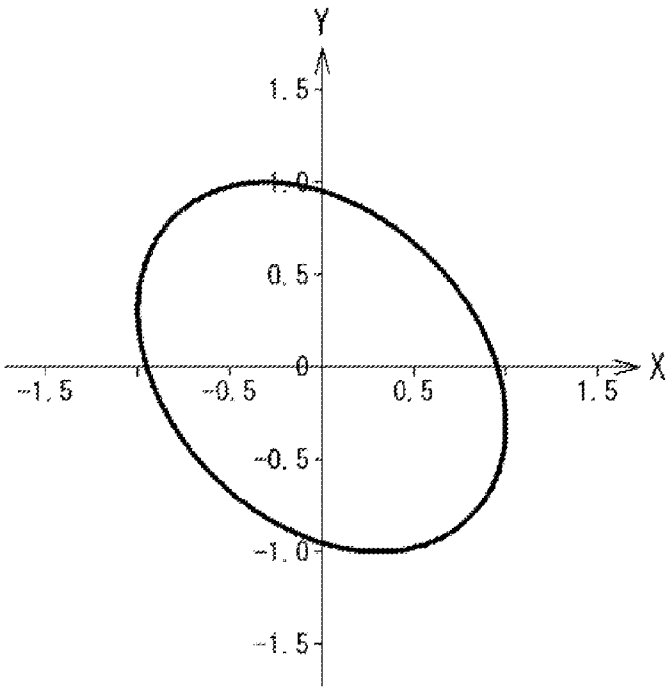
FIG. 8A is a graph showing another rotational trajectory of a holder member for abnormal agitation state.

FIG. 8A illustrates another case where the agitation becomes abnormal because the rotational trajectory of holder member 42 is oval. In this case, as illustrated in FIG. 8B, the amplitude Ax in the X-axis direction and the amplitude Ay in the Y-axis direction are equal to each other, whereas the phase difference θ is greater than 90°. Here, the rotational trajectory illustrated in FIG. 8A becomes an oval shape which is slightly flattened in a direction inclined from the X-axis direction as well as the Y-axis direction. When holder member 42 is rotated along the oval rotational trajectory as described above, the liquid in container 14 is prone to be agitated more in the major axis direction of the oval but less in the minor axis direction thereof, and to be incompletely mixed. As a consequence, the agitation becomes abnormal.

The vibration of holder member 42 may cause a variation as compared to the normal state of agitation due to an error in attachment of agitation unit 12, an error or variation in revolution speed of motor 45, a change in state of elastic member 43, and the like. In other words, holder member 42 may cause not only the normal state of agitation as illustrated in FIG. 5 but also the abnormal states of agitation as illustrated in FIG. 6A to FIG. 8B. The error in attachment of agitation unit 12 may occur due to a variation in state of connection of elastic member 43 with either support member 41 or holder member 42, for example. Meanwhile, the error in motor revolution speed may occur due to an individual difference of motor 45, and the variation in revolution speed of motor 45 may occur due to noise and the like generated in a surrounding environment. The change in state of elastic member 43 may occur due to a change in environmental temperature, time degradation, and the like.

As illustrated in FIG. 1, measurement control unit 21 of the first embodiment acquires the information on the amplitudes Ax and Ay and the phase difference θ of holder member 42 outputted from signal processing unit 22, and executes processing to be described below. Specifically, in the agitation abnormality illustrated in FIG. 6, the rotation radius r of holder member 42 is smaller than that in the normal state. Nevertheless, the rotational trajectory is in the perfect circular shape. It is therefore possible to correct the rotation radius back to normal by adjusting the revolution speed of motor 45. In the meantime, although it is not illustrated, if the rotation radius of holder member 42 is greater than that in the normal state, it is also possible to correct the rotation radius back to normal rotation radius r by adjusting the revolution speed of motor 45. Accordingly, when the rotational trajectory of holder member 42 is in the perfect circular shape, measurement control unit 21 adjusts the revolution speed of motor 45, thereby correcting the vibration so as to bring the rotation radius r back to normal. Thus, a variation in the state of agitation can be suppressed.

On the other hand, when the rotational trajectory of holder member 42 is in the imperfect circular shape as illustrated in FIG. 7A to FIG. 8B, it is unlikely that the rotational trajectory turns into a perfect circular shape even if the revolution speed of motor 45 is adjusted. Accordingly, measurement control unit 21 stops the drive of motor 45 and thereby stops the agitation itself instead of correcting the vibration. Then, measurement control unit 21 transmits information indicating the presence of the agitation abnormality to information processing unit 24. Information processing unit 24 notifies a user of the agitation abnormality by displaying the information indicating the presence of the agitation abnormality on display unit 36. Hence, the user can take measures for resolving the agitation abnormality.

In the first embodiment, the state of vibration of holder member 42 can be detected with the simple structure by detecting the acceleration rates in the two axial directions, namely, the X-axis direction and the Y-axis direction, by using detector 32.

Here, among the components constituting agitation unit 12, support member 41, holder member 42, elastic member 43, drive member 44, and detector 32 are integrally assembled into a unit component as illustrated in FIG. 2 and are attached to analyzer 10. In this specification, the above-described unit component is also referred to as an agitation unit. Here, the components can be replaced or distributed depending on each agitation unit.

(Processing Procedures Concerning Agitation Operation)

In the following, processing procedures of control unit 13 concerning the agitation by agitation unit 12 are described by using flowcharts. The processing procedures include the above-described determination as to whether or not the state of agitation is normal, and the control based on the determination.

Figure 9:
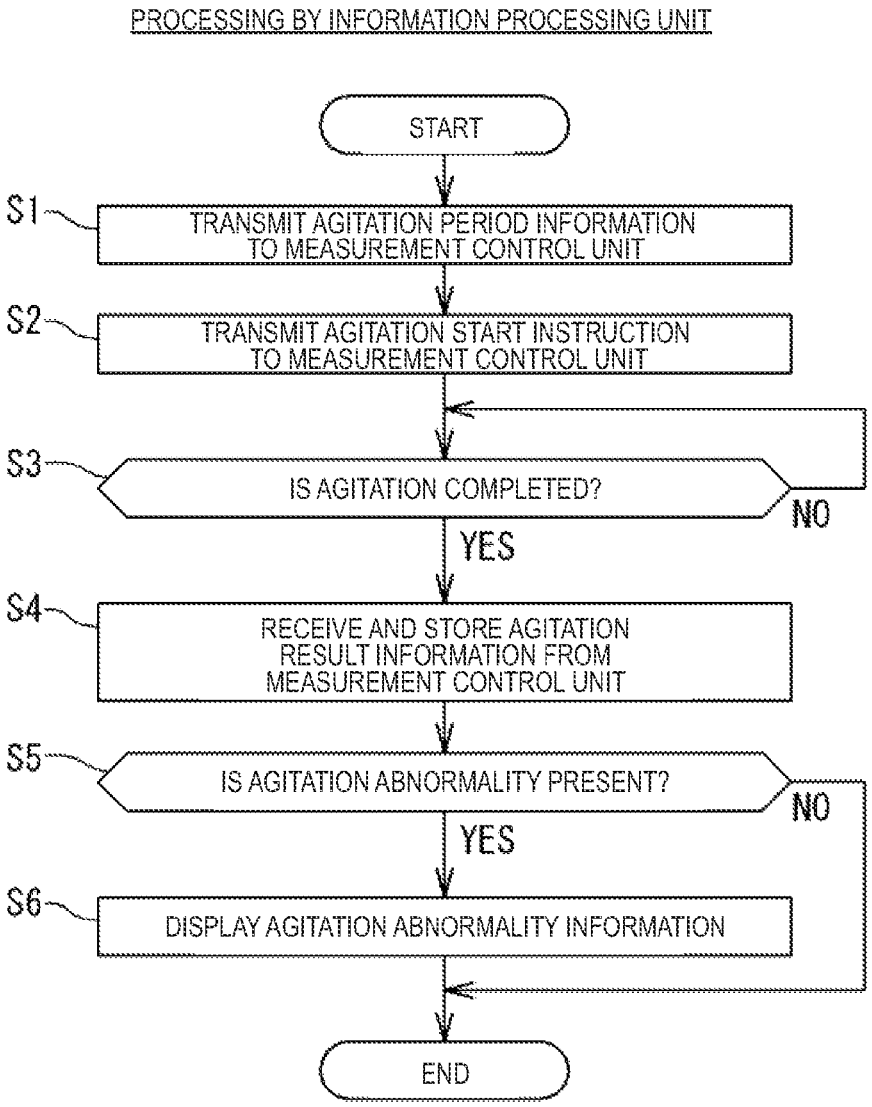
FIG. 9 is a flowchart illustrating processing procedures by an information processing unit.
Figure 10:
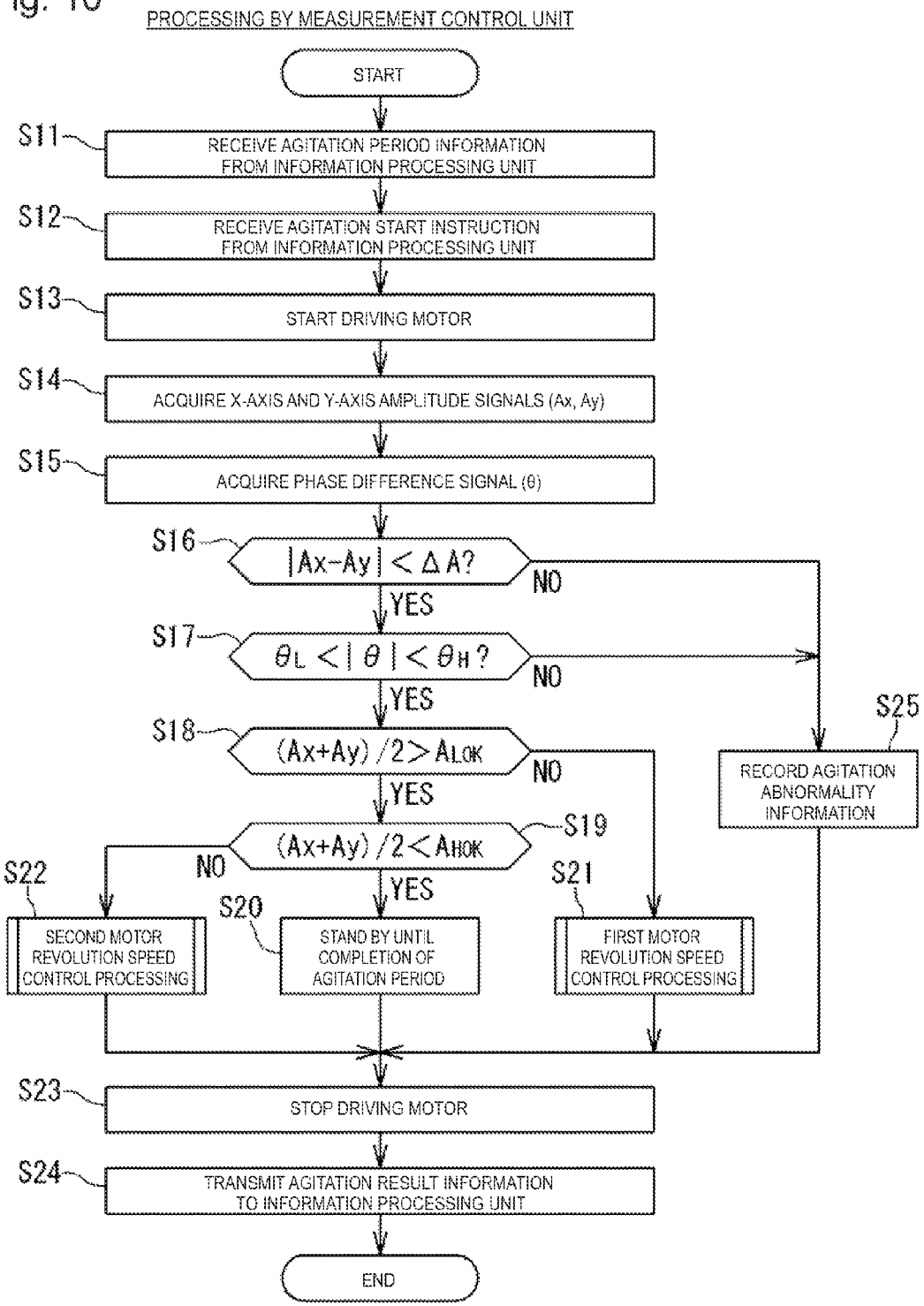
FIG. 10 is a flowchart illustrating processing procedures by a measurement control unit.

As illustrated in FIG. 9, information processing unit 24 transmits agitation period information to measurement control unit 21 in step S1. The agitation period information is information on time to be used by agitation unit 12 to agitate the liquid. The agitation period is set to one second, for example. Meanwhile, as illustrated in FIG. 10, measurement control unit 21 receives the agitation period information in step S11.

Subsequently, in step S2 of FIG. 9, information processing unit 24 transmits an agitation start instruction to measurement control unit 21. On the other hand, measurement control unit 21 receives the agitation start instruction in step S12 of FIG. 10. Thereafter, information processing unit 24 stands by until completion of the agitation operation by agitation unit 12 is recognized in step S3 of FIG. 9.

Measurement control unit 21 starts the agitation operation by agitation unit 12 on the basis of the agitation start instruction. Here, at the start of the agitation operation, container 14 containing the liquid is held in advance by catch section 47 of agitation unit 12. As illustrated in FIG. 10, measurement control unit 21 starts the drive of motor 45 in step S13. Container 14 held by catch section 47 performs the vibration by the drive of motor 45. The acceleration rates in the X-axis direction and the Y-axis direction attributed to the vibration are detected by detector 32. As illustrated in FIG. 1, the detection signals by detector 32 are inputted to signal processing unit 22.

Amplitude detection circuits 28 and 29 of signal processing unit 22 obtain the amplitudes Ax and Ay in the X-axis direction and the Y-axis direction, respectively, by using the detection signals from detector 32, and output the amplitudes Ax and Ay to measurement control unit 21. Measurement control unit 21 acquires signals of the amplitudes Ax and Ay in the X-axis direction and the Y-axis direction in step S14 of FIG. 10. In the meantime, phase detection circuit 27 obtains the phase difference θ between the phase in the X-axis direction and the phase in the Y-axis direction by using the detection signals from detector 32, and outputs the phase difference θ to measurement control unit 21. Measurement control unit 21 acquires a signal of the phase difference θ between the X-axis direction and the Y-axis direction in step S15.

In step S16, measurement control unit 21 determines whether or not a difference between the amplitudes Ax and Ay in the X-axis direction and the Y-axis direction is below a reference amplitude difference ΔA serving as a predetermined threshold. For example, the reference amplitude difference ΔA may be set to 30% of the amplitude in the normal state. In the example illustrated in FIG. 5B, the amplitudes Ax and Ay in the X-axis direction and the Y-axis direction in the normal state are each set to "1". Accordingly, the reference amplitude difference ΔA may be set to "0.3". Note that the value of the reference amplitude difference ΔA is a mere example and can be changed as appropriate depending on use conditions and the like.

Measurement control unit 21 moves the processing to step S17 when the difference between the amplitudes Ax and Ay is smaller than the reference amplitude difference ΔA, i.e., when the following formula (1) is met. Measurement control unit 21 moves the processing to step S25 when the difference between the amplitudes Ax and Ay is equal to or above the reference amplitude difference ΔA.

$$|Ax-Ay|<\Delta A \quad (1)$$

When the formula (1) is not met, the rotational trajectory of holder member 42 is considered to be in the oval shape as described with reference to FIG. 7A and FIG. 7B. In this case, it is possible to determine that there is an uncorrectable abnormality in the state of agitation. Accordingly, measurement control unit 21 records agitation abnormality information, which is information indicating the occurrence of the agitation abnormality, in storage unit 26 in step S25. Thereafter, measurement control unit 21 transmits a control signal to drive circuit 23 in step S23, thereby stopping motor 45.

When the above-described formula (1) is met, measurement control unit 21 determines whether or not the phase difference θ between the X-axis direction and the Y-axis direction falls within a predetermined range in step S17. The predetermined range may be defined as a range of 90°±20°, for example. In this case, an upper limit $\theta_H$ of the phase difference θ is equal to 110° while a lower limit $\theta_L$ thereof is equal to 70°. Measurement control unit 21 moves the processing to step S18 when the phase difference θ meets the following formula (2). Measurement control unit 21 moves the processing to step S25 when the phase difference θ does not meet the following formula (2).

$$\theta_L<|\theta|<\theta_H \quad (2)$$

When the formula (2) is not met, the rotational trajectory of holder member 42 is considered to be in the oval shape as described with reference to FIG. 8A and FIG. 8B. In this case, it is possible to determine that there is an uncorrectable abnormality in the state of agitation. Accordingly, measurement control unit 21 records the agitation abnormality information in storage unit 26 in step S25. Thereafter, measurement control unit 21 transmits the control signal to drive circuit 23 in step S23, thereby stopping motor 45.

When the above-described formula (2) is met, measurement control unit 21 determines whether or not an average value of the amplitude Ax in the X-axis direction and the amplitude Ay in the Y-axis direction is greater than a predetermined lower limit $A_{LOK}$ in step S18. Measurement control unit 21 moves the processing to step S19 when the average value of the amplitude Ax in the X-axis direction and the amplitude Ay in the Y-axis direction is greater than the predetermined lower limit $A_{LOK}$, i.e., when the following formula (3) is met. Measurement control unit 21 moves the processing to step S21 when the formula (3) is not met.

$$(A_x+A_y)/2>A_{LOK} \quad (3)$$

When the formula (3) is not met, it is possible to determine that the agitation abnormality occurs due to the reason that the rotation radius of holder member 42 is smaller than that in the normal state as described with reference to FIG. 6A and FIG. 6B. Accordingly, measurement control unit 21 executes the control of the motor revolution speed in step S21 and corrects the vibration such that the rotation radius of holder member 42 falls within a normal range. Processing procedures of the control of the motor revolution speed are described later. Here, the predetermined lower limit $A_{LOK}$ may be set to 70% of a value in the normal state, for example. In the example of the normal state illustrated in FIG. 5A and FIG. 5B, the average value of the amplitudes Ax and Ay is equal to "1". Accordingly, the predetermined lower limit $A_{LOK}$ may be set to "0.7".

When the formula (3) is met, measurement control unit 21 determines whether or not the average value of the amplitude Ax in the X-axis direction and the amplitude Ay in the Y-axis direction is smaller than a predetermined upper limit $A_{HOK}$ in step S19. Measurement control unit 21 moves the processing to step S20 when the average value of the amplitudes Ax and Ay is smaller than the predetermined upper limit $A_{HOK}$, i.e., when the following formula (4) is met. Measurement control unit 21 moves the processing to step S22 when the formula (4) is not met.

$$(A_x+A_y)/2<A_{HOK} \quad (4)$$

Although the size of the rotation radius r of holder member 42 is determined in step S18 and step S19 by using the average value of the amplitude Ax in the X-axis direction and the amplitude Ay in the Y-axis direction, the size of the rotation radius r of holder member 42 may be determined by using at least one amplitude out of the amplitude Ax in the X-axis direction and the amplitude Ay in the Y-axis direction.

When the formula (4) is not met, it is possible to determine that the agitation abnormality occurs due to the reason that the rotation radius of holder member 42 is greater than that in the normal state. Accordingly, measurement control unit 21 executes control of the motor revolution speed in step S22 and corrects the vibration such that the rotation radius of holder member 42 falls within the normal range. Processing procedures of the control of the motor revolution speed are described later. Here, the predetermined upper limit $A_{HOK}$ may be set to 130% of the average value in the normal state, for example. In the example of the normal state illustrated in FIG. 5A and FIG. 5B, the average value of the amplitudes Ax and Ay is equal to "1". Accordingly, the predetermined upper limit $A_{HOK}$ may be set to "1.3".

When all of the above-described formulae (1) to (4) are met, it is possible to determine that holder member 42 performs the vibration in accordance with the perfect rotational trajectory and the proper rotation radius as illustrated in FIG. 5A and FIG. 5B. Therefore, it is also possible to determine that the liquid in container 14 is normally agitated as well. In step S20, measurement control unit 21 continues the agitation while keeping the revolution speed of motor 45 constant until the agitation period is completed. Then, as the predetermined agitation period is completed, measurement control unit 21 transmits a control signal to drive circuit 23 in step S23 in order to stop motor 45. Meanwhile, in step S24, measurement control unit 21 sends information processing unit 24 information indicating completion of the agitation operation, and agitation result information indicating an agitation result.

(First Motor Revolution Speed Control)

Figure 11:
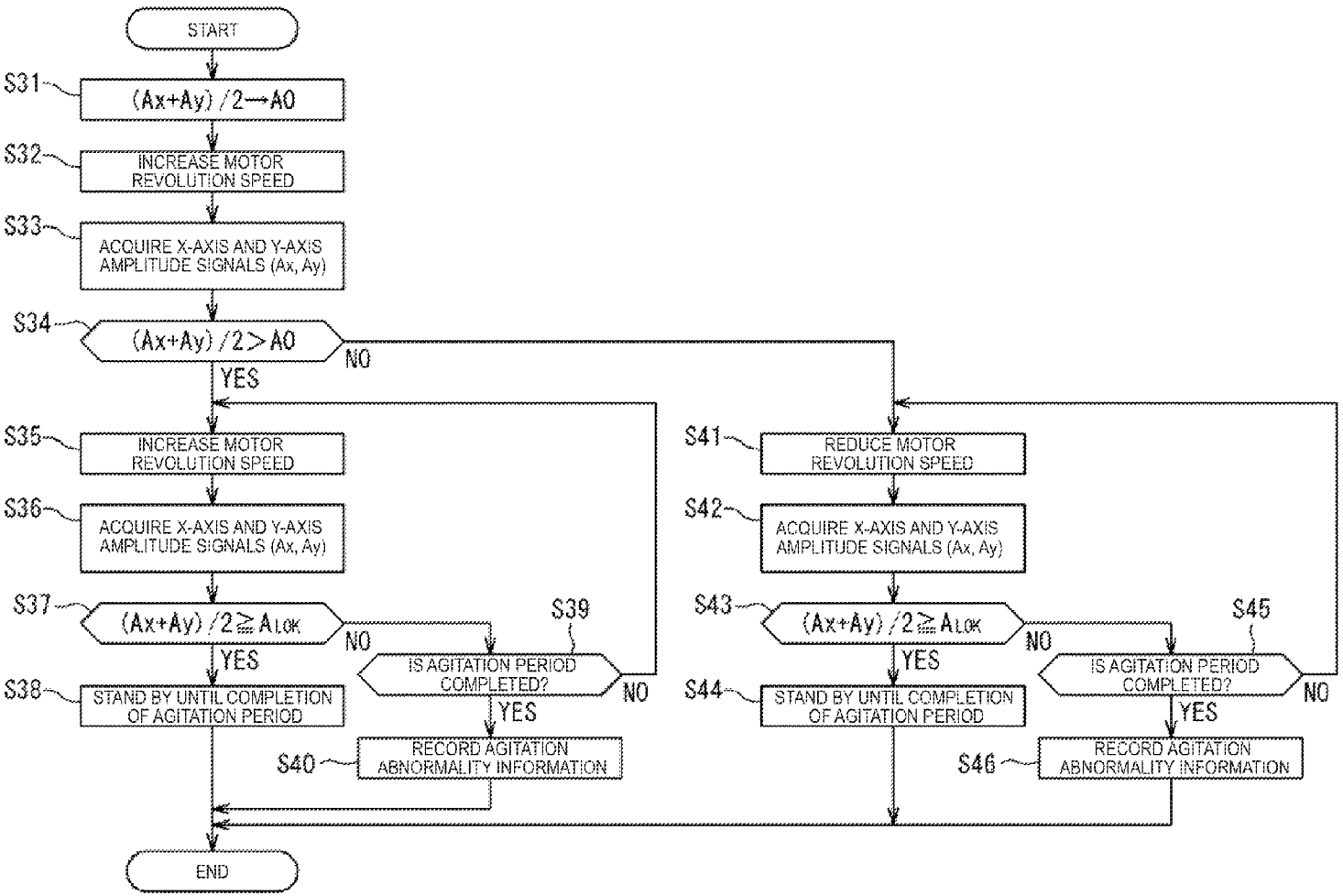
FIG. 11 is a flowchart illustrating procedures of first motor revolution speed control processing by the measurement control unit.

Next, the processing procedures of the control of the motor revolution speed in step S21 are described. Step S21 represents the processing procedures to take place when the rotation radius of holder member 42 is smaller than the normal range. As illustrated in FIG. 11, in step S31, measurement control unit 21 records the average value of the amplitude Ax in the X-axis direction and the amplitude Ay in the Y-axis direction as an initial value A0 in storage unit 26.

Next, in step S32, measurement control unit 21 transmits a control signal to drive circuit 23, thereby increasing the motor revolution speed. Then, in step S33, measurement control unit 21 acquires signals of new amplitudes Ax and Ay from amplitude detection circuits 28 and 29 of signal processing unit 22.

In step S34, measurement control unit 21 obtains an average value of the new amplitudes Ax and Ay, and compares the average value with the initial value A0. Measurement control unit 21 moves the processing to step S35 when the average value of the new amplitudes Ax and Ay turns out to be greater than the initial value A0, or moves the processing to step S41 when the average value of the new amplitudes Ax and Ay turns out to be smaller than the initial value A0.

When the average value of the new amplitudes Ax and Ay is greater than the initial value A0, the rotation radius of holder member 42 is made greater by increasing the motor revolution speed. Accordingly, it is possible to correct the rotation radius, which is smaller than the normal range, in such a way as to bring the rotation radius closer to the normal range. In step S35, measurement control unit 21 transmits the control signal to drive circuit 23, thereby further increasing the motor revolution speed.

Measurement control unit 21 acquires signals of other new amplitudes Ax and Ay from amplitude detection circuits 28 and 29 in step S36, and compares an average value of the amplitudes Ax and Ay with the lower limit $A_{LOK}$ of the normal range of the rotation radius in step S37. Measurement control unit 21 determines that the rotation radius is corrected in such a way as to fall within the normal range when the average value of the amplitudes Ax and Ay turns out to be equal to or above the lower limit $A_{LOK}$, and moves the processing to step S38. In step S38, measurement control unit 21 stands by while keeping the motor revolution speed constant until the agitation period is completed, and continues the agitation.

When the average value of the amplitudes Ax and Ay turns out to be smaller than the lower limit $A_{LOK}$ in step S37, it is possible to determine that the rotation radius of holder member 42 is not increased enough to fall within the normal range. In this case, in step S39, measurement control unit 21 determines whether or not the agitation period is completed. When the agitation period is not completed, measurement control unit 21 transmits the control signal to drive circuit 23 in step S35, thereby increasing the motor revolution speed again.

Thereafter, measurement control unit 21 executes the processing of steps S36 and S37 again. If the average value of the amplitudes Ax and Ay does not become equal to or above the lower limit $A_{LOK}$ on or before the completion of the agitation period, then measurement control unit 21 determines that it is impossible to correct the rotation radius of holder member 42 in such a way as to fall within the normal range. Accordingly, in step S40, measurement control unit 21 stores agitation abnormality information indicating the occurrence of the agitation abnormality in storage unit 26. The agitation abnormality information is used later for notifying the user of the agitation abnormality.

On the other hand, when the average value of the amplitudes Ax and Ay is equal to or below the initial value A0 in step S34, measurement control unit 21 moves the processing to step S41 and reduces the motor revolution speed by transmitting the control signal to drive circuit 23. In other words, the rotation radius becomes smaller despite the increase in the motor revolution speed in step S32. Accordingly, measurement control unit 21 performs the control to reduce the motor revolution speed instead.

Subsequently, measurement control unit 21 acquires signals of other new amplitudes Ax and Ay from amplitude detection circuits 28 and 29 in step S42, and compares an average value of the amplitudes Ax and Ay with the lower limit $A_{LOK}$ of the normal range in step S43. Measurement control unit 21 determines that the rotation radius is corrected in such a way as to fall within the normal range when the average value of the amplitudes Ax and Ay turns out to be equal to or above the lower limit $A_{LOK}$. In step S44, measurement control unit 21 stands by while keeping the motor revolution speed constant until the agitation period is completed, and continues the agitation.

When the average value of the amplitudes Ax and Ay is smaller than the lower limit $A_{LOK}$ in step S43, it is possible to determine that the rotation radius of holder member 42 is not increased enough to fall within the normal range. In this case, in step S45, measurement control unit 21 determines whether or not the agitation period is completed. When the agitation period is not completed, measurement control unit 21 transmits the control signal to drive circuit 23 in step S41, thereby reducing the motor revolution speed again.

Measurement control unit 21 executes the processing of steps S42 and S43 again. If the average value of the amplitudes Ax and Ay does not become equal to or above the lower limit $A_{LOK}$ on or before the completion of the agitation period, then measurement control unit 21 determines that it is impossible to correct the rotation radius of holder member 42 in such a way as to fall within the normal range. Accordingly, in step S46, measurement control unit 21 stores agitation abnormality information indicating the occurrence of the agitation abnormality in storage unit 26. The agitation abnormality information is also used later for notifying the user of the agitation abnormality.

(Second Motor Revolution Speed Control)

Figure 12:
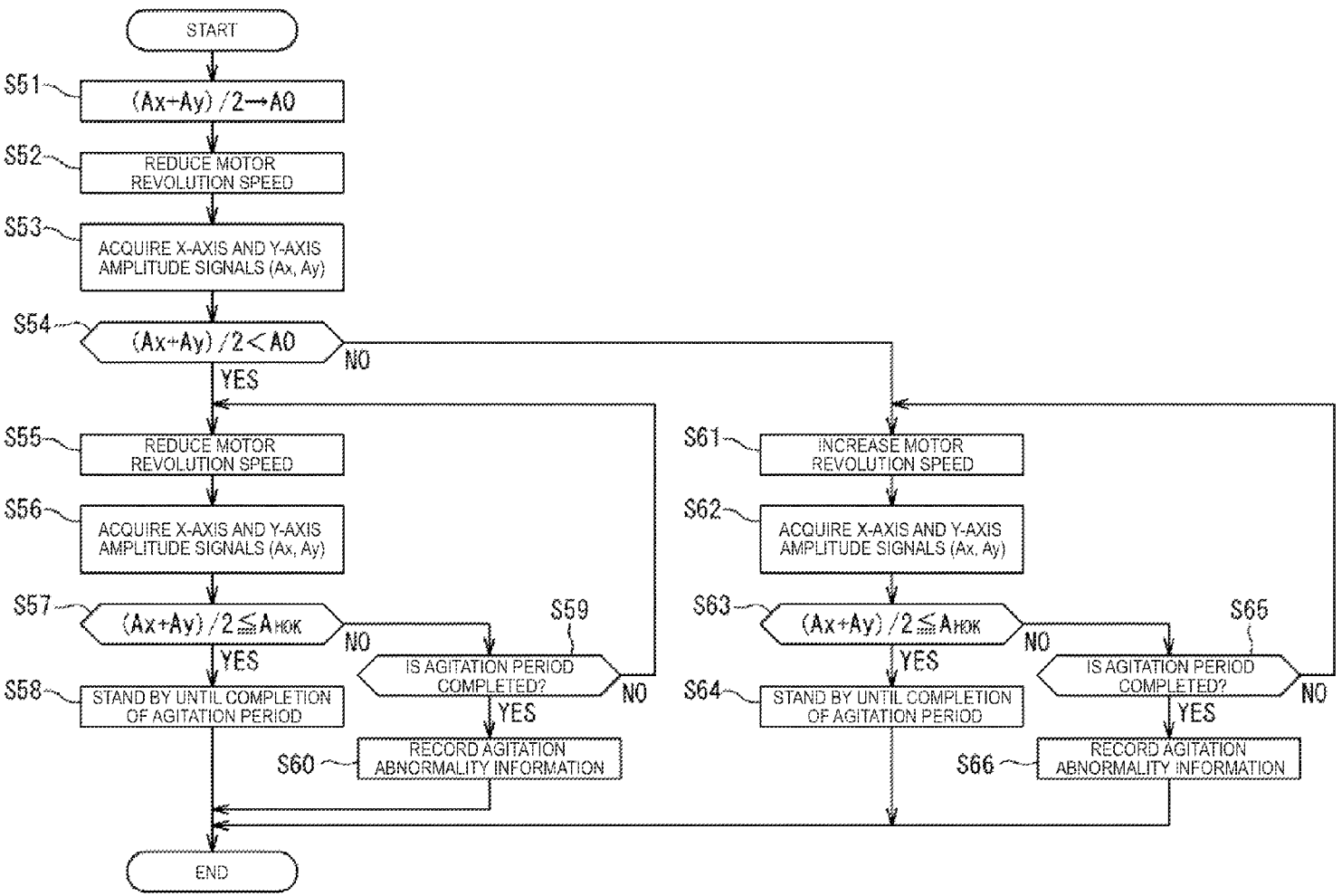
FIG. 12 is a flowchart illustrating procedures of second motor revolution speed control processing by the measurement control unit.

Next, the processing procedures of the control of the motor revolution speed in step S22 of FIG. 10 are described. Step S22 represents the processing procedures to take place when the rotation radius of holder member 42 is greater than the normal range. As illustrated in FIG. 12, in step S51, measurement control unit 21 records the average value of the amplitude Ax in the X-axis direction and the amplitude Ay in the Y-axis direction as the initial value A0 in storage unit 26.

Next, in step S52, measurement control unit 21 transmits a control signal to drive circuit 23, thereby reducing the motor revolution speed. Then, in step S53, measurement control unit 21 acquires signals of new amplitudes Ax and Ay from amplitude detection circuits 28 and 29 of signal processing unit 22.

Subsequently, in step S54, measurement control unit 21 obtains an average value of the new amplitudes Ax and Ay, and compares the average value with the initial value A0.

Measurement control unit 21 moves the processing to step S55 when the average value of the new amplitudes Ax and Ay turns out to be smaller than the initial value A0, or moves the processing to step S61 when the average value of the new amplitudes Ax and Ay turns out to be equal to or above the initial value A0.

When the average value of the new amplitudes Ax and Ay is smaller than the initial value A0, the rotation radius of holder member 42 is made smaller by reducing the motor revolution speed. Accordingly, it is possible to correct the rotation radius, which is greater than the normal range, in such a way as to bring the rotation radius closer to the normal range. In step S55, measurement control unit 21 transmits the control signal to drive circuit 23, thereby further reducing the motor revolution speed.

Measurement control unit 21 acquires signals of other new amplitudes Ax and Ay from amplitude detection circuits 28 and 29 in step S56, and compares an average value of the amplitudes Ax and Ay with the upper limit $A_{HOK}$ of the normal range of the rotation radius in step S57. Measurement control unit 21 determines that the rotation radius is corrected in such a way as to fall within the normal range when the average value of the amplitudes Ax and Ay turns out to be equal to or below the upper limit $A_{HOK}$, and moves the processing to step S58. In step S58, measurement control unit 21 stands by while keeping the motor revolution speed constant until the agitation period is completed, and continues the agitation.

When the average value of the amplitudes Ax and Ay turns out to be greater than the upper limit $A_{HOK}$ in step S57, it is possible to determine that the rotation radius of holder member 42 is not reduced enough to fall within the normal range. In this case, in step S59, measurement control unit 21 determines whether or not the agitation period is completed. When the agitation period is not completed, measurement control unit 21 transmits the control signal to drive circuit 23 in step S55, thereby reducing the motor revolution speed again.

Thereafter, measurement control unit 21 executes the processing of steps S56 and S57 again. If the average value of the amplitudes Ax and Ay does not become equal to or below the upper limit $A_{HOK}$ on or before the completion of the agitation period, then measurement control unit 21 determines that it is impossible to correct the rotation radius of holder member 42 in such a way as to fall within the normal range. Accordingly, in step S60, measurement control unit 21 stores agitation abnormality information indicating the occurrence of the agitation abnormality in storage unit 26. The agitation abnormality information is used later for notifying the user of the agitation abnormality.

On the other hand, when the average value of the amplitudes Ax and Ay is equal to or above the initial value A0 in step S54, measurement control unit 21 moves the processing to step S61 and increases the motor revolution speed by transmitting the control signal to drive circuit 23. In other words, the rotation radius of holder member 42 becomes greater despite the reduction in the motor revolution speed in step S52. Accordingly, measurement control unit 21 performs the control to increase the motor revolution speed instead.

Subsequently, measurement control unit 21 acquires signals of other new amplitudes Ax and Ay from amplitude detection circuits 28 and 29 in step S62, and compares an average value of the amplitudes Ax and Ay with the upper limit $A_{HOK}$ of the normal range in step S63. Measurement control unit 21 determines that the rotation radius is corrected in such a way as to fall within the normal range when the average value of the amplitudes Ax and Ay turns out to be equal to or below the upper limit $A_{HOK}$. In step S64, measurement control unit 21 stands by while keeping the motor revolution speed constant until the agitation period is completed, and continues the agitation.

When the average value of the amplitudes Ax and Ay is greater than the upper limit $A_{HOK}$ in step S63, it is possible to determine that the rotation radius of holder member 42 is not reduced enough to fall within the normal range. In this case, in step S65, measurement control unit 21 determines whether or not the agitation period is completed. When the agitation period is not completed, measurement control unit 21 transmits the control signal to drive circuit 23 in step S61, thereby increasing the motor revolution speed again.

Measurement control unit 21 executes the processing of steps S62 and S63 again. If the average value of the amplitudes Ax and Ay does not become equal to or below the upper limit $A_{HOK}$ on or before the completion of the agitation period, then measurement control unit 21 determines that it is impossible to correct the rotation radius of holder member 42 in such a way as to fall within the normal range. Accordingly, in step S46, measurement control unit 21 stores agitation abnormality information indicating the occurrence of the agitation abnormality in storage unit 26. The agitation abnormality information is also used later for notifying the user of the agitation abnormality.

When the first and second motor revolution speed control illustrated in FIG. 11 and FIG. 12 is completed, in step S23, measurement control unit 21 transmits the control signal to drive circuit 23 as illustrated in FIG. 10 so as to stop the drive of motor 45. In step S24, measurement control unit 21 transmits the agitation result information to information processing unit 24, and terminates the processing. The agitation result information includes not only information indicating that the agitation is normally performed, but also the agitation abnormality information recorded in storage unit 26 in steps S40 and S46 of FIG. 11 and steps S60 and S66 of FIG. 12.

(Notification of Agitation Abnormality)

Back to FIG. 9, in step S4, information processing unit 24 receives the agitation result information from measurement control unit 21 and stores the agitation result information in storage unit 35. Subsequently, in step S5, information processing unit 24 determines whether or not the agitation abnormality information is included in the agitation result information. When the agitation abnormality information is included, information processing unit 24 displays the agitation abnormality information on display unit 36 to notify the user of the occurrence of the agitation abnormality, and then terminates the processing.

The user can perceive the occurrence of the agitation abnormality of the liquid by viewing the agitation abnormality information on display unit 36, and promptly conduct measures for eliminating the cause of the agitation abnormality, such as maintenance work including adjustment or replacement of a component. Meanwhile, since the agitation result information is stored in storage unit 35 of information processing unit 24, the user can check later whether or not there was the agitation abnormality. Accordingly, if there is a defect in the analysis result, then it is possible to check whether or not there was any problem during the agitation.

In the above-described first embodiment, analyzer 10 includes agitation unit 12 which agitates the liquid, analysis unit 11 which performs the analysis by using the agitated liquid, and control unit 13 which controls the operation of agitation unit 12. Agitation unit 12 includes vibrator 31 which vibrates the container containing the liquid, and detector 32 which detects the state of vibration. Control unit 13 causes vibrator 31 to correct the vibration on the basis of the detection result by detector 32. Accordingly, analyzer 10 can suppress the variation in the state of agitation.

Control unit 13 performs the notification of the presence of the agitation abnormality when the variation in the state of agitation remains even after the correction of the vibration by holder member 42, i.e., when the agitation abnormality is not resolved. Accordingly, it is possible to notify the user of the agitation abnormality when the variation in the state of agitation remains even after the correction of the vibration is performed.

Control unit 13 acquires the amplitudes Ax and Ay in the X-axis direction and the Y-axis direction as well as the phase difference θ between the X-axis direction and the Y-axis direction from the detection result by detector 32. Control unit 13 corrects the vibration when the rotation radius of holder member 42 obtained from the amplitudes Ax and Ay is not in the normal range. Control unit 13 performs the notification of the presence of the agitation abnormality when the shape of the rotational trajectory obtained from the amplitude difference and the phase difference θ between the X-axis direction and the Y-axis direction is not in the perfect circular shape. Accordingly, control unit 13 can correct the vibration when the variation in the state of agitation can be suppressed by correcting the vibration. When it is not possible to suppress the variation in the state of agitation by correcting the vibration, control unit 13 can promptly notify the user of the agitation abnormality.

[Second Embodiment]

Figure 13:
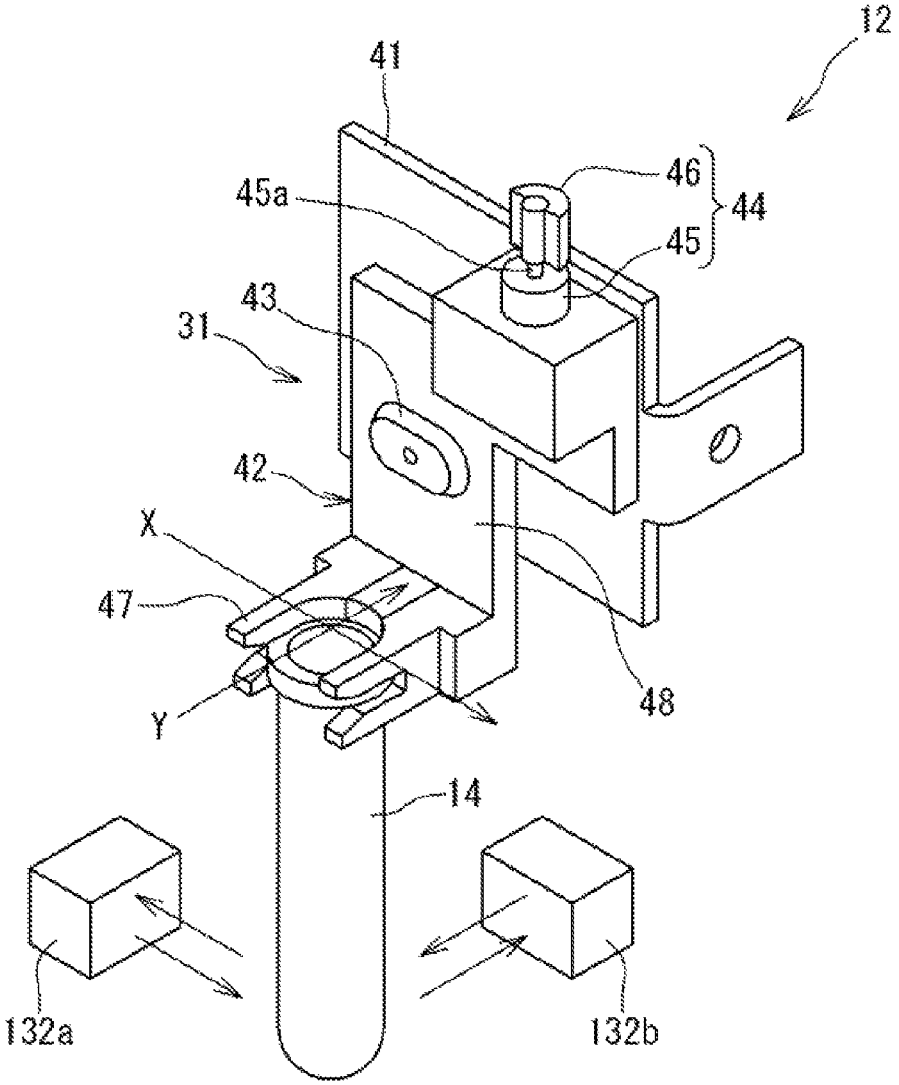
FIG. 13 is a perspective view of an agitation unit according to a second embodiment.

In the above-described first embodiment, detector 32 that detects the state of vibration of container 14 is formed from the acceleration sensor. In a second embodiment, the detector is formed from optical sensors 132*a* and 132*b*, as illustrated in FIG. 13. Optical sensors 132*a* and 132*b* include optical sensor 132*a* which detects a change in position in the X-axis direction of container 14, and optical sensor 132*b* which detects a change in position in the Y-axis direction of container 14. Optical sensors 132*a* and 132*b* are not attached to holder member 42 but are attached to a different component which is not illustrated.

Each of optical sensors 132*a* and 132*b* includes a light emitter and a light receiver. The light emitter transmits an optical signal to container 14 while the light receiver receives the optical signal reflected from container 14. Each of optical sensors 132*a* and 132*b* is capable of measuring a distance from the sensor to container 14 by transmission and reception of the optical signal, and detecting a change in position of container 14. Accordingly, it is possible to obtain the amplitudes Ax and Ay in the X-axis direction and the Y-axis direction of the container and the phase difference θ by use of detection results of optical sensors 132*a* and 132*b*, and to use the detection results for the determination of the agitation abnormality, the correction of the vibration, and the like. In the second embodiment, the vibration of container 14 can be detected directly. Thus, it is possible to perceive the state of agitation more accurately.

It is to be understood that the above-described embodiments are mere examples in all aspects and are not restrictive. The scope of embodiments is defined not by the above description but by the appended claims, and is intended to encompass all changes within the meaning and the scope equivalent to the claims.

The detector in the first embodiment may be formed from two acceleration sensors provided for the X-axis direction and the Y-axis direction, respectively, or may be formed from one acceleration sensor which is capable of detecting the acceleration rates in both the X-axis direction and the Y-axis direction.

In the above-described representative embodiments, the case of vibrating the holder member and the container along the perfect circular rotational trajectory is defined as normal while the case of vibrating the holder member and the container along the oval rotational trajectory is defined as abnormal. However, the definition of being normal and abnormal may be the other way around.

Although the vibrator in the above-described embodiments puts each of the holder member and the container into the rotational motion, the vibrator may put each of the holder member and the container into a swinging motion in one direction.

In the above-described embodiments, the case where the rotation radius of each of the holder member and the container falls within the predetermined normal range is determined as the normal agitation. Instead, it is possible to define only the lower limit of the normal rotation radius and a rotation radius equal to or above the lower limit may be determined as normal. In this case, the processing of steps S19 and S22 in FIG. 10 and the processing illustrated in FIG. 12 can be omitted.

In the above-described embodiments, storage unit 26 records the agitation abnormality information being the information indicating the occurrence of the agitation abnormality, the average value of the amplitude Ax in the X-axis direction and the amplitude Ay in the Y-axis direction, and the agitation result information. However, the scope of embodiments is not limited only to this configuration. Storage unit 26 may store the difference between the amplitudes Ax and Ay in the X-axis direction and the Y-axis direction, the phase difference θ between the X-axis direction and the Y-axis direction, and the signals detected by detector 32. Meanwhile, a set of the information acquired in an agitation step during an analysis of each sample by analyzer 10 may be stored in storage unit 26 for each agitation step while linking the information to the corresponding sample. The sets of the information are useful in light of traceability of the analysis results of the samples.

In the meantime, as an initial operation at a start-up of the analyzer 10, a liquid such as a reagent may be dispensed into container 14 prior to an analysis, then an agitation operation may take place in order to detect whether or not the agitation abnormality occurs. In this way, it is possible to suppress waste of the sample and the reagent due to the agitation abnormality.

In the above-described embodiments, the immune analyzer is depicted as an example of analyzer 10. However, the scope of embodiments is not limited only to the foregoing. As analyzer 10, the scope of embodiments is also applicable to clinical sample analyzers including a blood coagulation measuring apparatus, a multi-parameter hematology analyzer, a urine formed element analyzer, a genetic amplification measuring apparatus, and the like.

The agitation device described in Patent Document 1 is likely to cause a variation in a state of agitation attributed to an error in assembling components, to a variation in revolution speed of the vibration motor, and the like.

In representative embodiments described above, it is possible to suppress a variation in a state of agitation of a liquid. These and other embodiments readily will be appreciated by a skilled artisan reader and are not intended to limit the scope of the claims. Space considerations preclude addition of embellishments that are known to the skilled artisan. Referenced documents are incorporated by reference in their entireties and specifically with respect to their taught structures.

The invention claimed is:

1. An analyzer comprising:

an agitation unit comprising a vibrator; and a detector; and a control unit comprising a processor, the processor configured with a program to perform operations comprising:

controlling the agitation unit to agitate a liquid by controlling the vibrator to cause a vibration of a container containing the liquid, controlling the detector to detect the vibration of the container and output a signal to the control unit, receiving the signal output from the detector, and regulating the vibrator based on receiving the signal.

2. The analyzer according to claim 1, wherein the vibrator comprises a motor, and the processor of the control unit is configured with the program to perform operations such that regulating the vibrator comprises controlling a revolution speed of the motor.

3. The analyzer according to claim 1, wherein the processor of the control unit is configured with the program to perform operations comprising generating a notification in a condition in which an agitation abnormality is detected from the detector signal.

4. The analyzer according to claim 1, wherein the processor of the control unit is configured with the program to perform operations comprising generating a notification in a condition in which an abnormal agitation variation remains after the vibration is regulated.

5. The analyzer according to claim 1, wherein the processor of the control unit is configured with the program to perform operations such that regulating the vibrator comprises regulating the vibrator by comparing a predetermined threshold with a state parameter obtained from the detector signal.

6. The analyzer according to claim 1, wherein the processor of the control unit is configured with the program to perform operations comprising obtaining a first state parameter and a second state parameter from the detector signal, when a change in state is determined based on the first state parameter, regulating the vibrator to correct the change, and when a change is alarmed based on the second state parameter, signaling the presence of an agitation abnormality.

7. The analyzer according to claim 1, wherein the processor of the control unit is configured with the program to perform operations comprising storing at least one of a detection signal and information derived from the detection signal.

8. The analyzer according to claim 1, wherein the vibrator comprises:

a holder member that holds the container;

a support member that supports the holder member;

an elastic member that connects the support member to the holder member; and a drive member that is attached to the holder member and vibrates the holder member pivotally around the elastic member.

9. The analyzer according to claim 8, wherein the detector is an acceleration sensor that is attached to the holder member and senses acceleration of the holder member from the vibration.

10. The analyzer according to claim 8, wherein the detector is an optical sensor that senses a change in position of the container.

11. The analyzer according to claim 8, wherein the detector senses vibration in two axial directions orthogonal to each other.

12. The analyzer according to claim 11, wherein the processor of the control unit is configured with the program to perform operations comprising correcting the vibration based on comparing a vibration amplitude in at least one of the two axial directions with a predetermined threshold.

13. The analyzer according to claim 11, wherein the processor of the control unit is configured with the program to perform operations comprising causing the vibrator to correct vibration amplitude based on a comparison of a predetermined threshold with an average value of vibration amplitudes in the two axial directions.

14. The analyzer according to claim 11, wherein the processor of the control unit is configured with the program to perform operations comprising generating a notification of the presence of an agitation abnormality based on a comparison of a predetermined threshold with a difference between vibration amplitudes in the two axial directions.

15. The analyzer according to claim 11, wherein the processor of the control unit is configured with the program to perform operations comprising generating a notification of alarms the presence of an agitation abnormality based on a comparison of a predetermined threshold with a phase difference between vibrations in the two axial directions.

16. The analyzer according to claim 1, wherein the processor of the control unit is configured with the program to perform operations comprising controlling the agitation unit to perform an agitation operation prior to an analysis of a sample and determines whether an abnormality occurs in the vibration.

17. The analyzer according to claim 1, wherein the vibrator causes the container to rotate.

18. The analyzer according to claim 1, wherein the vibrator comprises:

a motor; and a weight provided at such a position that gravity center of the weight is decentered from the rotation center of an output shaft of the motor.

19. A control unit comprising:

an agitation unit comprising a holder member that holds a container containing a liquid;

a support member that supports the holder member;

an elastic member that connects the support member to the holder member;

a drive member that is attached to the holder member and vibrates the holder member pivotally around the elastic member; and a detector that is attached to the holder member and detects a state of vibration of the holder member; and a processor configured with a program to perform operations comprising:

controlling the agitation unit to cause the agitation unit to vibrate the holder member;

receiving a signal generated by the detector of the state of vibration of the holder member; and regulating the agitation unit based on the received signal.

20. The agitation unit according to claim 19, wherein the detector is an acceleration sensor that senses an acceleration of the holder member attributed to the vibration.

* * * * *